US009038600B2

(12) United States Patent
Stichlmeir et al.

(10) Patent No.: US 9,038,600 B2
(45) Date of Patent: May 26, 2015

(54) FUEL FEED DEVICE AND METHOD FOR PRODUCING A FUEL FEED DEVICE

(75) Inventors: Maximilian Stichlmeir, Ingolstadt (DE); Sven Troester, Neuburg/Donau (DE); Dirk Höfner, Wellheim (DE); Jürgen Becker, Landshut (DE); Georg Dertinger, Borchen (DE); Markus Mehring, Lichtenau (DE); Damian Zwiener, Paderborn (DE)

(73) Assignees: AUDI AG, Ingolstadt (DE); BENTELER AUTOMOBILTECHNIK GmbH, Paderborn (DE)

( * ) Notice: Subject to any disclaimer, the term of this patent is extended or adjusted under 35 U.S.C. 154(b) by 268 days.

(21) Appl. No.: 13/643,251

(22) PCT Filed: Apr. 27, 2011

(86) PCT No.: PCT/EP2011/002110
§ 371 (c)(1),
(2), (4) Date: Oct. 24, 2012

(87) PCT Pub. No.: WO2011/134651
PCT Pub. Date: Nov. 3, 2011

(65) Prior Publication Data

US 2013/0047961 A1 Feb. 28, 2013

(30) Foreign Application Priority Data

Apr. 28, 2010 (DE) ..... 10 2010 018 615

(51) Int. Cl.

| | |
|---|---|
| ***F02M 55/02*** | (2006.01) |
| ***F02M 69/46*** | (2006.01) |
| *F02M 55/00* | (2006.01) |

(52) U.S. Cl.
CPC ..... *F02M 55/025* (2013.01); *F02M 55/02* (2013.01); *F02M 2200/8084* (2013.01); *F02M 55/004* (2013.01); *F02M 69/465* (2013.01)

(58) Field of Classification Search
CPC ... F02M 69/465; F02M 55/004; F02M 55/02; F02M 55/025; F02M 2200/8084
USPC ..... 123/456, 447, 468, 469, 470, 28, 30
See application file for complete search history.

(56) References Cited

U.S. PATENT DOCUMENTS 6,640,783 B2 11/2003 Braun et al.

(Continued)

FOREIGN PATENT DOCUMENTS

| | | |
|---|---|---|
| DE | 102006061563 | 7/2008 |
| DE | 102008044923 | 3/2010 |
| DE | 102009006607 A1 * | 8/2010 |
| DE | 102009038079 | 3/2011 |

(Continued)

OTHER PUBLICATIONS

102008044923-Desc-en (Markus Mahring) Apr. 3, 2010 (machine translation). [online] [retrieved on Sep. 9, 2014]. Retrieved from EPO Website.*

*Primary Examiner* — Mahmoud Gimie
(74) *Attorney, Agent, or Firm* — Henry M. Feiereisen LLC

(57) ABSTRACT

A fuel feed device for attachment to a cylinder head of an internal combustion engine has at least one fuel distribution element extending along a longitudinal direction, and at least one connecting element extending transversely to the longitudinal direction, wherein the connecting element can be used to connect the fuel distribution element to the cylinder head. The fuel feed device further includes at least one reinforcing element which is connected, on one hand, to an outer surface of the fuel distribution element and, on the other hand, to the connecting element outside the fuel distribution element.

6 Claims, 10 Drawing Sheets

(56) References Cited

U.S. PATENT DOCUMENTS

| | | | | |
|---|---|---|---|---|
| 7,143,749 | B1 * | 12/2006 | Colletti | 123/469 |
| 2008/0302336 | A1 * | 12/2008 | Fuerst et al. | 123/470 |
| 2009/0107473 | A1 * | 4/2009 | Imoehl et al. | 123/549 |

FOREIGN PATENT DOCUMENTS

| | | |
|---|---|---|
| EP | 1 772 620 | 4/2007 |
| EP | 2 204 573 | 7/2010 |
| JP | 2001-289137 | 10/2001 |

* cited by examiner

10

FUEL FEED DEVICE AND METHOD FOR PRODUCING A FUEL FEED DEVICE

CROSS-REFERENCES TO RELATED APPLICATIONS

This application is the U.S. National Stage of International Application No. PCT/EP2011/002110, filed Apr. 27, 2011, which designated the United States and has been published as International Publication No. WO 2011/134651 and which claims the priority of German Patent Application, Serial No. 10 2010 018 615.5, filed Apr. 28, 2010, pursuant to 35 U.S.C. 119(a)-(d).

BACKGROUND OF THE INVENTION

The invention relates to a fuel feed device for attachment to a cylinder head of an internal combustion engine, with at least one fuel distribution element extending along a longitudinal direction and at least one connecting element extending transverse to the longitudinal direction, via which the fuel distribution element is connectable to the cylinder head, and a method for producing such fuel feed device.

EP 1 772 60 B1 discloses a generic device for attaching a high-pressure fuel accumulator to a cylinder head, with a high-pressure fuel accumulator, which has a main pipe extending along a longitudinal axis. The device also includes several fluid-tight passageways which are formed to extend completely through the aforementioned high-pressure fuel accumulator and extend substantially perpendicular to the longitudinal axis, as well as several screws which can be inserted through the respective several fluid-tight passageways. The fastening elements can here be mounted on the cylinder head, by which the high-pressure fuel accumulator is mounted on the cylinder head. The fluid-tight passageways are entirely formed by the aforementioned main pipe of the high-pressure fuel accumulator.

This device disadvantageously has an increased risk for leaks, which would allow fuel to leak from the high-pressure fuel accumulator, unless other measures are implemented.

SUMMARY OF THE INVENTION

It is therefore an object of the present invention to provide a fuel feed device and a method for producing such a fuel feed device with improved and more secure functional performance.

An inventive fuel feed device for attachment to a cylinder head of an internal combustion engine having at least one fuel distribution element extending along a longitudinal direction and at least one connecting element extending transverse, in particular perpendicular, to the longitudinal direction, via which the fuel distribution element can be connected to the cylinder head, is characterized by at least one reinforcing element, which is connected, on one hand, to an outer surface of the fuel distribution element and, on the other hand, with the connecting element outside, in particular exclusively outside, the fuel distribution element.

With the reinforcing element, the connection between the fuel distribution element, which is also referred to as the fuel rail, and the connecting element is reinforced. As a result, the probability of an occurrence of a leak and thus a leakage of fuel received in the fuel distribution element is significantly reduced.

Because the reinforcing element is connected to an outer surface of the fuel distribution element, a particularly large connecting surface exists between the reinforcing element and the fuel distribution element. This leads to lower stresses in the connecting surface when the fuel in the fuel distribution element is under very high pressure. This is particularly advantageous when the reinforcing element is materially connected, in particular soldered, to the fuel distribution element and/or to the connecting element. Due to the available large connecting surface, the mechanical stress, for example in the weld seam, is low. The large connecting surface is under less stress even in the presence of a very high internal pressure in the fuel distribution element and biasing forces from injectors cooperating with the fuel feed device, which significantly reduces the probability of a failure, for example, of the weld seam, and thus destruction of the entire fuel feed device.

The aforementioned advantages can be attained without increasing a wall thickness of the fuel distribution element and thus also its weight. This keeps the total weight of the fuel feed device within a small range. The number of attachment points and connecting surfaces between the connecting element and the fuel distribution element can be kept low, which in turn leads to a low weight and low cost of the fuel feed device.

A connecting surface between the reinforcing element and the connecting element is particularly large, wherein low stresses, and thus also low loads in the connecting surface, exist due to the large connecting surface even at a high internal pressure in the fuel distribution element, even in the presence of mechanical bias forces due to attached injectors, as well as the fuel feed device connected to the cylinder head. Because the reinforcing element and the connecting member are soldered together, this reduces the load on the weld seam, which positively affects the functional performance and reliability of the fuel feed device.

Preferably, the reinforcing element is formed as a reinforcing plate which advantageously has a receptacle corresponding to an outer contour of the fuel distribution element in which the fuel distribution element is at least partially received, and which extends away from the fuel distribution element at an angle, in particular transversely, with respect to the longitudinal direction. The reinforcing element is thus shaped as a collar, by which the fuel feed device is reinforced in the connecting region between the fuel distribution element and the connecting element.

The functions of the fuel feed device are then safely met to a particularly high degree when the connecting element is materially connected to the fuel distribution element, in particular soldered.

A particularly strong and rigid connection with a long service life is realized in a particularly preferred embodiment of the invention, wherein a receiving space is formed between the reinforcing element and the connecting element and/or between the reinforcing element and the fuel distribution element, in which receiving space a connecting means, in particular a connecting means for materially connecting the reinforcing element to the connecting element and/or the reinforcing element to the fuel distribution element, such as solder, adhesive and/or the like, are received. In this case, a particularly large surface area for forming, for example, a solder joint, is available which significantly reduces stresses in the solder joint.

According to another embodiment, the reinforcing element may have at least one through-opening extending into the receiving space, through which the connecting means, such as the solder, may be introduced. In this way, liquid solder can also be introduced into the exception of the receiving space which is enclosed on all sides with the exception of the through-opening.

In a further advantageous embodiment, the fuel feed device includes two reinforcing elements, which are each connected, on one hand, to the outer surface of the fuel distribution element and, on the other hand, with the connecting element outside, in particular exclusively outside, the fuel distribution element. For example, the connecting element hereby passes through the fuel distribution element and protrudes by a certain distance from both sides of the connecting element in the axial direction, i.e., on both a top side and a bottom side. For example, one of the two connecting elements is now arranged on the top side of the fuel distribution element and connected, on one hand, to the outer surface of the fuel distribution element and, on the other hand, to the connecting element. The second of the reinforcing elements is then arranged at the bottom side and connected, on one hand, to the outer surface of the fuel distribution element and, on the other hand, to the connecting element. This provides a particularly strong connection between the connecting element and the fuel distribution element. In addition, the stresses in the corresponding connecting surfaces between the respective reinforcing elements and the connecting element and/or the fuel distribution element are very small, resulting in a long service life of the fuel feed device.

The invention also relates to a method of producing a fuel feed device for attachment on a cylinder head of an internal combustion engine having at least one fuel distribution element extending along a longitudinal direction and at least one connecting element extending transverse, in particular perpendicular, to the longitudinal direction, via which the fuel distribution element can be connected to the cylinder head, wherein in one step of the method, a receiving space is formed between an attachment piece and the fuel distribution element and/or the connecting element for a connecting means for connecting the attachment piece to the fuel distribution element and/or the connecting element. The connecting means can then be placed or introduced in this receiving space, producing a particularly large connecting surface between the attachment piece and the fuel distribution element and/or the connecting element. This also keeps the load on the connection surface, in particular in this tension, low, thereby providing a fuel feed device which has a high functional performance and reliability and therefore a long service life.

Further advantages, features and details of the invention will become apparent from the following description of a preferred exemplary embodiment and with reference to the drawings. The features and feature combinations mentioned above in the description and the features and feature combinations mentioned below in the description of the drawings and/or the features and feature combinations shown solely in the figures can be used not only in the respective described combination, but also in other combinations or in isolation, without deviating from the scope of the invention.

DETAILED DESCRIPTION OF PREFERRED EMBODIMENTS

Figure 1:
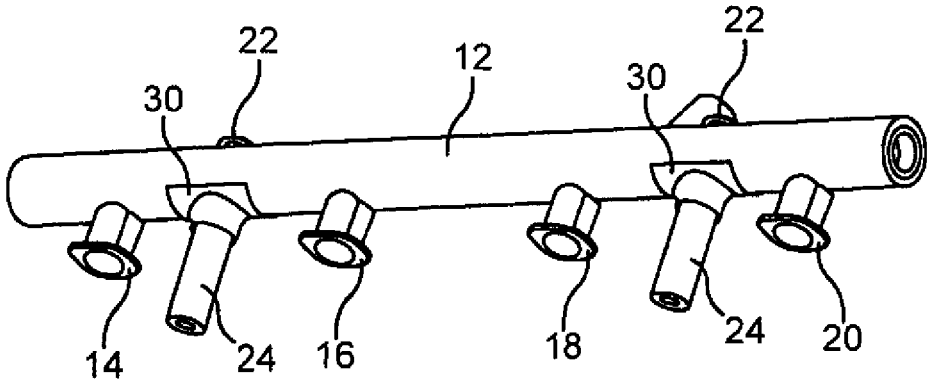
FIG. 1 a schematic diagram of a high-pressure fuel accumulator for a direct injection gasoline or diesel engine, which is connected via sleeves to a cylinder head of the gasoline or diesel engine.

FIG. 1 shows a high-pressure fuel reservoir 10 with a fuel distribution pipe 12 for a direct-injection gasoline or diesel engine. During operation of the gasoline or diesel engine, fuel is pressurized by a high pressure pump and fed into the fuel distribution pipe 12, which distributes the fuel to injectors. The injectors inject the fuel into each cylinder. For this purpose, receptacles 14, 16, 18 and 20 of the high-pressure fuel accumulator 10 are provided, with a corresponding injector inserted into each receptacle and for supplying the injector with fuel from the fuel distribution pipe 12.

Figure 2:
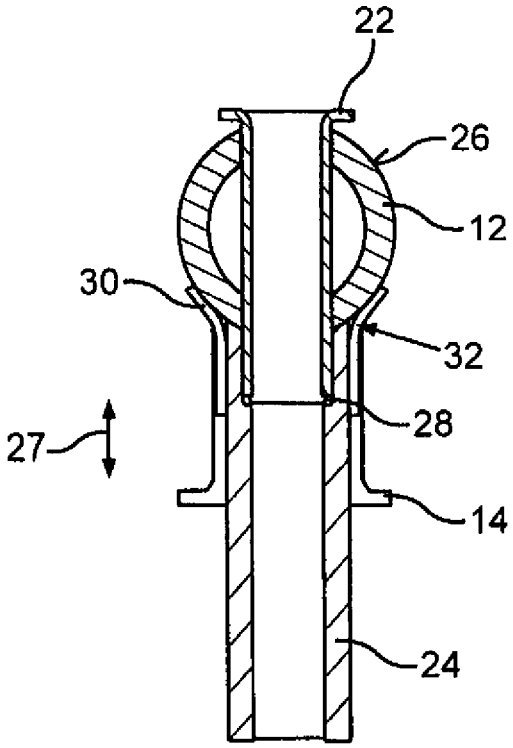
FIG. 2 a section of a schematic cross-sectional view of the high-pressure fuel accumulator according to FIG. 1.
Figure 3:
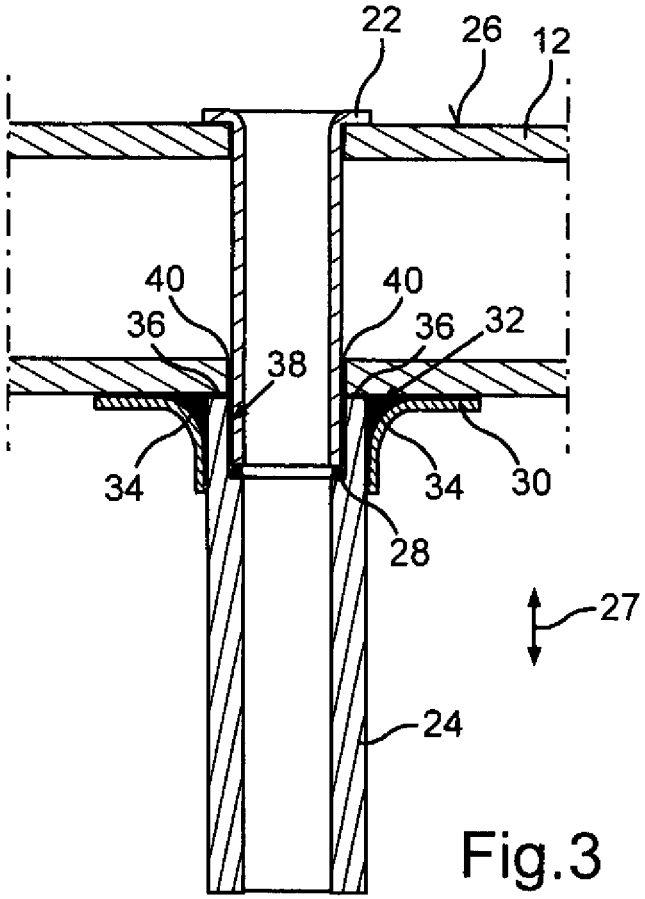
FIG. 3 a section of a schematic longitudinal sectional view of the high-pressure fuel accumulator according to the preceding figures.

As seen clearly in the context of FIGS. 2 and 3, the high-pressure fuel accumulator 10 includes sleeves 22 and 24 connecting the high-pressure fuel accumulator 10 with a cylinder head of the gasoline or diesel engine. The sleeve 22 passes completely through the fuel distribution pipe 12, i.e., is guided through corresponding through-openings in an outer surface 26 of the fuel distribution pipe 12 and extends through these through-openings. Moreover, the sleeve 22 is inserted into a corresponding receptacle of the sleeve 24. To prevent fuel from exiting between the sleeves 22 and 24, a sealing element 28 is provided between the sleeves 22 and 24 in the axial direction in the direction of arrow 27.

The high-pressure fuel reservoir 10 further includes reinforcing plates 30, wherein the respective reinforcing plate 30 is soldered, on one hand, to the outer surface 26 and, on the other hand, to the sleeve 24 exclusively on the outside of the fuel distribution pipe 12.

Moreover, a receiving space 32, in which the solder for soldering is received, is formed between the reinforcing plate 30 and the sleeve 24 and the fuel distribution pipe 12. In this way, soldering surfaces 34 are available for soldering the reinforcing plate 30 to the fuel distribution pipe 12 and the sleeve 24, ensuring a particularly strong connection of the fuel distribution pipe 12 with the sleeve 24. Moreover, the sleeve 24 is connected with solder applied to additional soldering surfaces 36 with the fuel distribution pipe 12, with solder applied at soldering surfaces 38 with the sleeve 22. The sleeve 22 is connected, via solder applied to corresponding solder surfaces 40, with fuel distribution pipe 12.

The reinforcing plate 30 provides very large solder surfaces 34, which in particular greatly relieves a solder seam between the fuel distribution pipe 12 and the sleeve 22, thereby lowering the probability for crack formation and formation of leaks in the high-pressure fuel accumulator 10.

When the fuel distribution pipe 12 has a high internal pressure and when the high-pressure fuel accumulator 10 is screwed to the cylinder head with bolts passing through the sleeves 22 and 24, the stresses and thus loads remain low in the solder surfaces 34, 36, 38 and 40, resulting in a very low risk for cracking. Since the reinforcing plate 30 is connected to the outer surface 26 and extends in the axial direction away from the fuel distribution pipe 12, the size especially of the soldering surface 34 does not depend on the wall thickness of the fuel distribution pipe 12, as is the case, for example, with the soldering surface 40. This produces a rigid connection between the fuel distribution pipe 12 and the sleeves 22 and 24, without increasing the weight of the fuel distribution pipe 12.

For arranging solder in the receiving space 32, the reinforcing plate 30 has at least one through opening 46 (FIG. 5) facing the receiving space 32, into which liquid or viscous solder paste, for example copper paste, may be introduced. For soldering the sleeve 22 with the sleeve 24, a solid solder ring is provided, which is melted in the soldering process in a continuous furnace, thereby soldering the sleeve 22 to the sleeve 24. The remaining solder seems and solder joints are shown here with the solder paste.

In other words, the high-pressure fuel accumulator 10 is produced by first plugging the sleeves 22 and 24 and the reinforcing plate 30 together, whereby the seal 28 and any solid solder rings are also mounted. The pre-assembled high-continuous pressure fuel accumulator 10 is then transported into and conveyed through the furnace for forming the respective solder joint. Thereafter, in a final assembly of the gasoline or diesel engine, the high-pressure fuel accumulator 10 is attached to the cylinder head, whereby the screws are guided through the sleeves 22 and 24 and screwed into the cylinder head.

Instead of the two sleeves 22 and 24 shown in the figures, only the sleeve 22 may be provided, whereby the seal 28 and a corresponding solder joint between the sleeve 22 and 24 is omitted. In this case, the connecting plate 30 is soldered, on one hand, to the outer surface 26 of the fuel distribution pipe 12 and, on the other hand, to the sleeve 22. The stresses on the corresponding solder surfaces during operation are also low in this embodiment of the high-pressure fuel accumulator 10, which results in a highly functional and reliable performance of the high-pressure fuel accumulator 10 and a very low probability for the occurrence of leaks.

Figure 4:
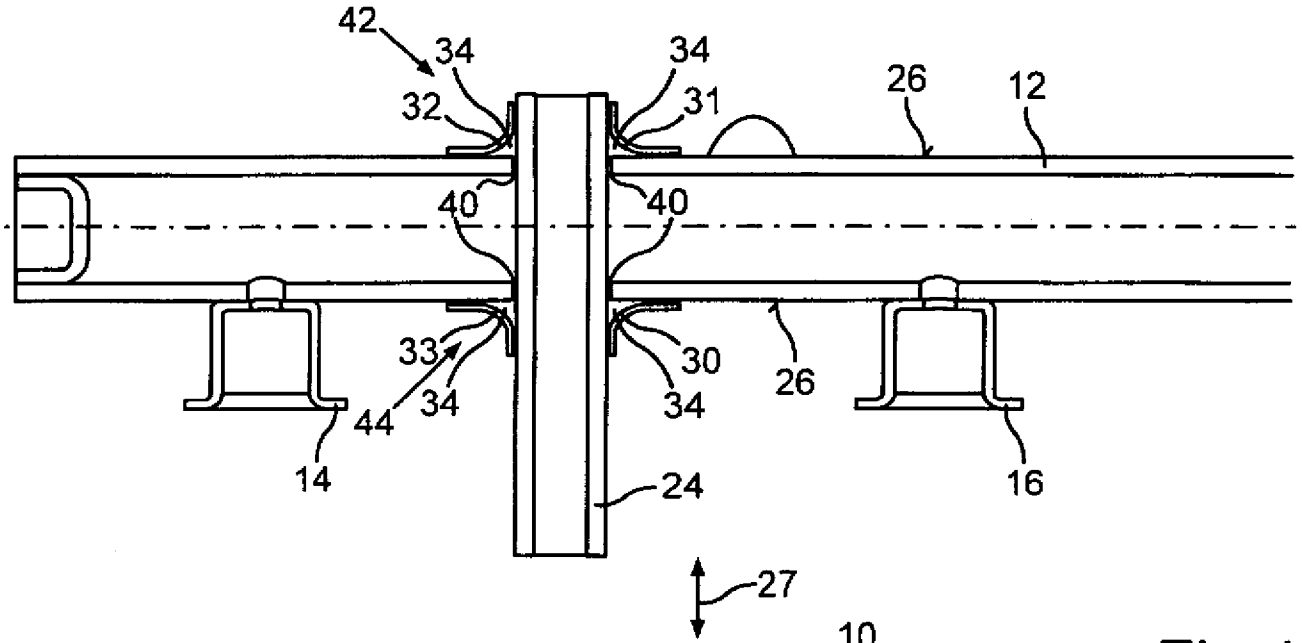
FIG. 4 a section of a schematic longitudinal sectional view of another embodiment of a high-pressure fuel accumulator according to the preceding figures.

FIG. 4 shows another embodiment of the high-pressure fuel accumulator 10 in accordance with the preceding figures, wherein only the sleeves 24 are now provided to connect the high-pressure fuel accumulator 10 to the cylinder head. An exemplary sleeve 24 representing the sleeves 24 is shown in FIG. 4. The sleeve 22 like the sleeve 24 penetrates the fuel distribution pipe 12 and is guided through and passes through corresponding through-holes in the outer surface 26 of the fuel distribution pipe 12. The sleeve 24 protrudes from the fuel distribution pipe 12 in the axial direction of the sleeve 24 according to the direction of arrow 27, both on a top side 42 of the fuel distribution pipe 12 as well as on a bottom side 44 of the fuel distribution tube 12. The reinforcing plate 30 is arranged on the bottom side 44, which like the high-pressure fuel accumulator 10 in accordance with FIGS. 1 to 3 is soldered, on one hand, to the outer surface 26 of the fuel distribution pipe 12 and, on the other hand, to the sleeve 24 exclusively outside of the fuel distribution pipe 12.

Moreover, an additional reinforcing plate 31 is arranged on the top side 42, which like the reinforcing plate 30 is soldered, on one hand, to the outer surface 26 of the fuel distribution pipe 12 and, on the other hand, to the sleeve 24 exclusively outside of the fuel distribution pipe 12. A respective receiving space 32, in which the solder for soldering is received, is formed once more between the reinforcing plates 30 and 31 and the sleeve 24 and the fuel distribution pipe 12. In analogy to the reinforcing plate 30, the reinforcing plate 31 also has solder surfaces 34 for soldering the reinforcing plate 30 to the fuel distribution pipe 12 and the sleeve 24 in order to provide a particularly strong connection. The sleeve 24 is also soldered to the fuel distribution pipe 12 with solder applied to other solder surfaces 40. By providing two reinforcing plates 30 and 31 on both the top side 42 and on the bottom side 44, the solder surfaces 34 and 40 are subjected to very low loads and stresses during the operation of the gasoline or diesel engine, resulting in a long service life of the high-pressure fuel accumulator 10.

Figure 5:
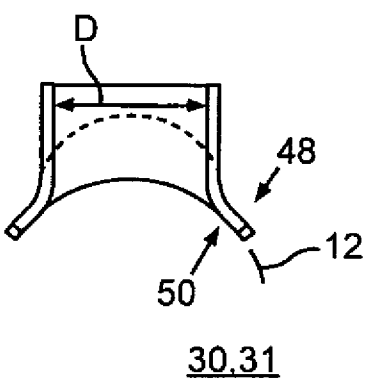
FIG. 5 a schematic longitudinal sectional view and a schematic cross-sectional view of a reinforcement sheet for a high-pressure fuel accumulator according to the preceding figures.
Figure 5:
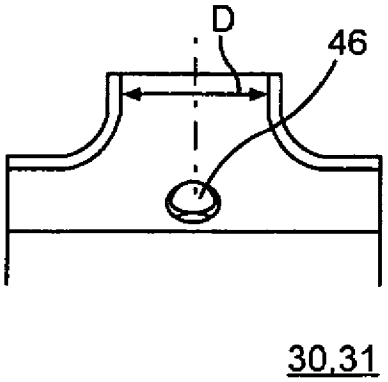

FIG. 5 shows the reinforcing plate 30, 31; the through-opening 46 which opens into the receiving chamber 32 and through which the solder paste can be introduced is also seen in FIG. 5. FIG. 5 also shows that the reinforcing plate 30, 31 has in a connecting region 48 a receiving contour 50 which corresponds to the outer contour of the outer surface 26 of the fuel distribution pipe 12 schematically shown in FIG. 5. This ensures a defined contact the reinforcing plate 30 with the fuel distribution pipe 12 and to the outer surface 26. A diameter D of the reinforcing plate 30, 31 for passage of the sleeve 24 is, for example, at least substantially in a range from 11 mm to 12 mm and in particular in a range from 11.8 mm to 11.95 mm, with both end values included. The diameter D should hereby be matched to an outer diameter of the sleeve 24 so as to be able to introduce, on one hand, a sufficient quantity of solder paste between the reinforcing plate 30, 31 and the sleeve 24 and, on the other hand, not to make a gap too large for the formation of a which it connection between the reinforcing plate 30, 31 and the sleeve 24

Figure 6:
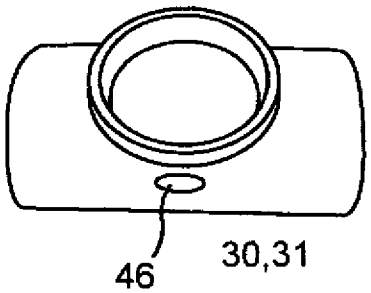
FIG. 6 a schematic perspective view of the reinforcement sheet according to FIG. 5.

FIG. 6 shows the reinforcing plate 30, 31 in a perspective view with the through-opening 46.

Figure 7B:
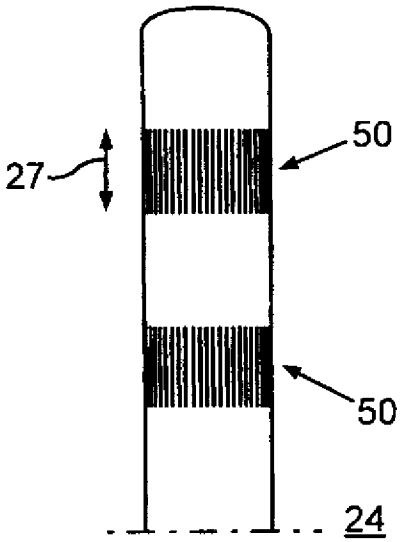
FIG. 7B a detail of a schematic and enlarged plan view of the sleeve according to FIG. 7A.
Figure 7A:
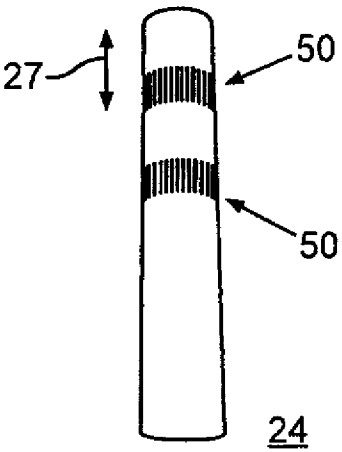
FIG. 7A a schematic plan view of a sleeve for a high-pressure fuel accumulator according to the preceding figures.

FIGS. 7A and 7B illustrate an alternative embodiment of the sleeve 24. The sleeve 24 has knurls 50 in the region of the solder surfaces 40, i.e. in a connecting region between the sleeve 24 and the fuel distribution pipe 12. Moreover, the sleeve 24 has in the axial direction in accordance with the direction arrow 27 an outer diameter step between the knurls 50, wherein an outer diameter of the sleeve 24 is at least substantially less by 0.1 mm than the other outer diameter of the sleeve 24

Figures 8A, 8B:
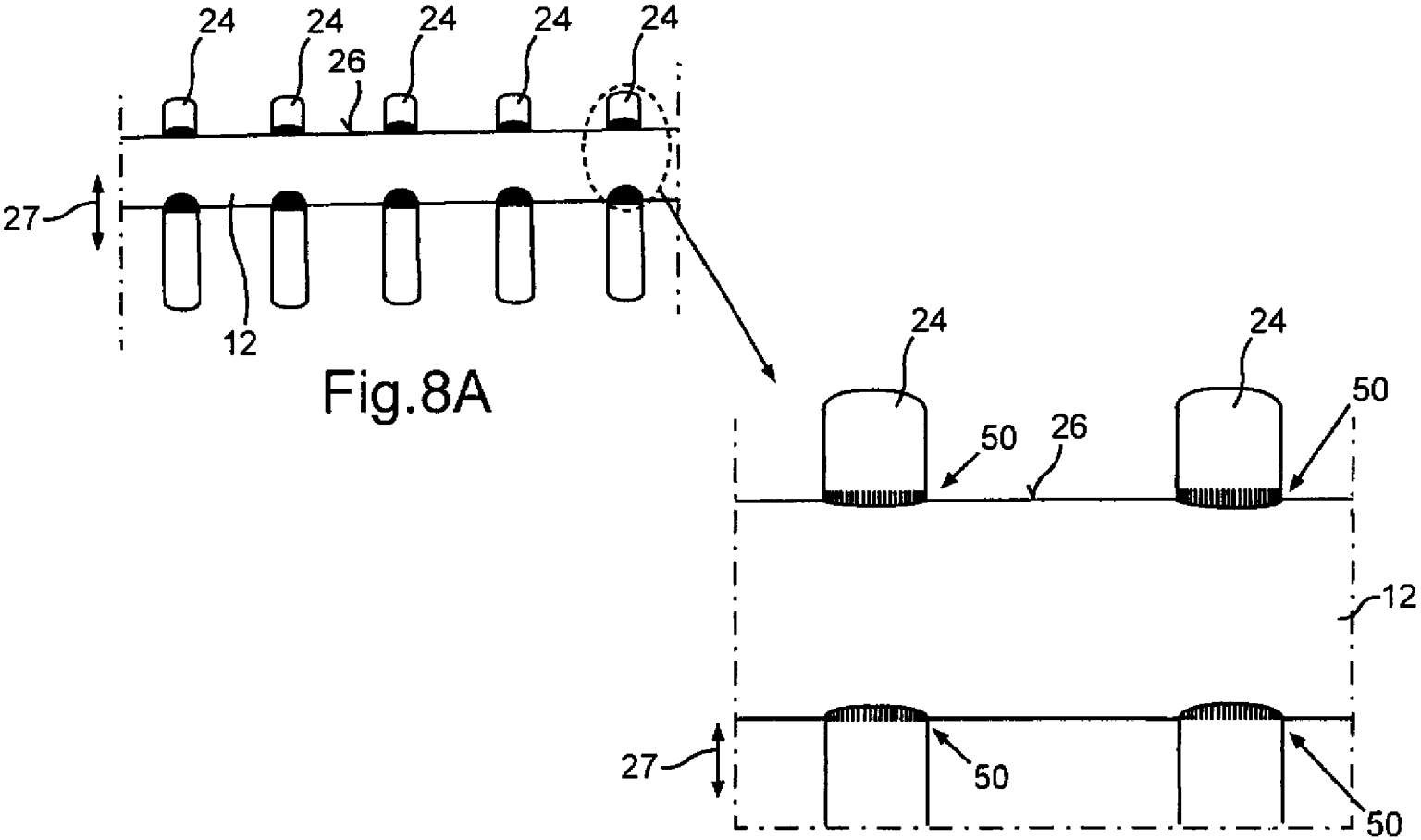
FIG. 8A a detail of a schematic plan view of a high-pressure fuel accumulator according to the preceding figures, with the sleeve according to FIGS. 7A and 7B.
FIG. 8B a detail of a schematic and enlarged plan view of the high-pressure fuel accumulator according to FIG. 8A.

FIGS. 8A and 8B show the sleeves 24 with the knurls 50, which are inserted through corresponding through-holes in the outer surface 26 of the fuel distribution pipe 12. Solder paste for soldering the sleeves 24 to the fuel distribution pipe 12 is then applied in the region of the knurls 50.

Figure 9A:
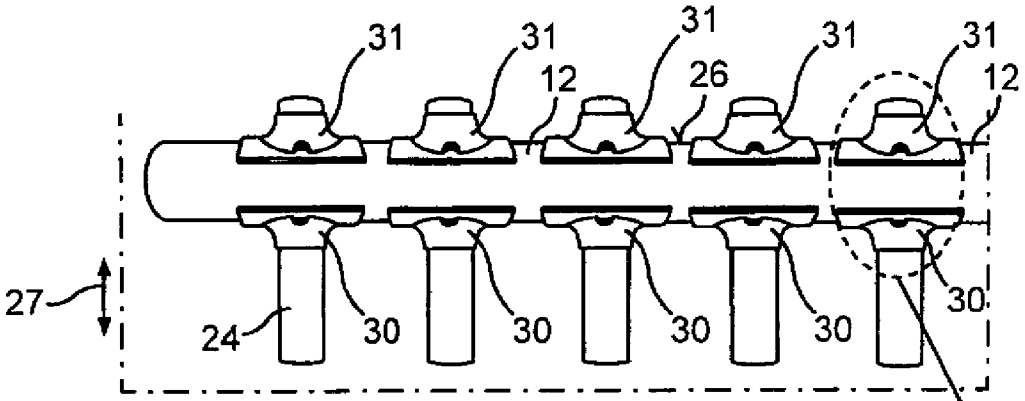
FIG. 9A a schematic plan view of the high-pressure fuel accumulator according to FIGS. 8A and 8B with the reinforcing plate according to FIG. 6.
Figure 9B:
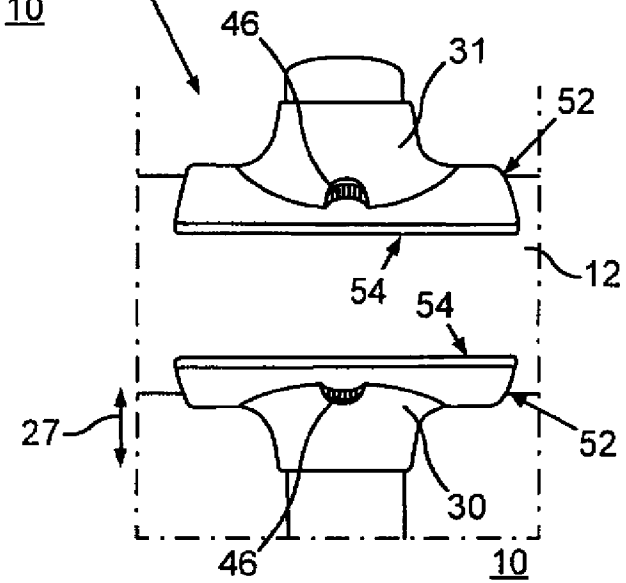
FIG. 9B a detail of a schematic and enlarged plan view of the high-pressure fuel accumulator according to FIG. 9A.

FIGS. 9A and 9B show the high-pressure fuel accumulator 10 with the reinforcing sheets 30 and 31 and the sleeves 24 with the knurls 50, wherein the sleeves 24 are soldered to the fuel distribution pipe 12 by way of the solder applied to the solder surfaces 40. The reinforcing plates 30 and 31 are also soldered by way of solder applied to the solder surfaces 34 to the sleeve 24 and/or the fuel distribution pipe 12. In addition, the reinforcing plates 30 and 31 are soldered to the fuel distribution pipe 12 by way of solder applied to solder surfaces lands 52 and 54.

Figure 10:
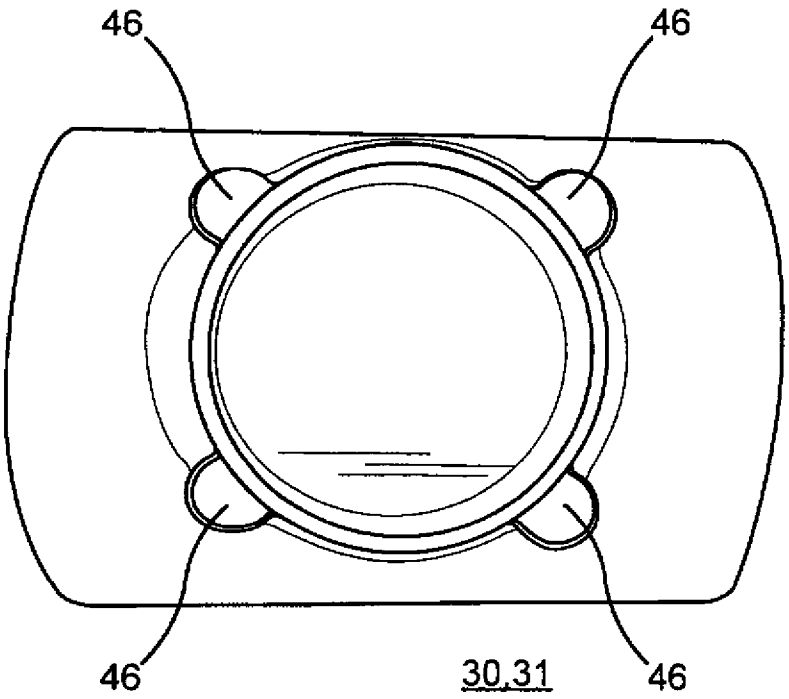
FIG. 10 a schematic plan view of another embodiment of a reinforcing panel according to FIG. 6.

FIG. 10 shows an additional embodiment of the reinforcing plate 30, 31, which now has four through-openings 46, via which solder can be introduced into the receiving space 32.

Figure 11B:
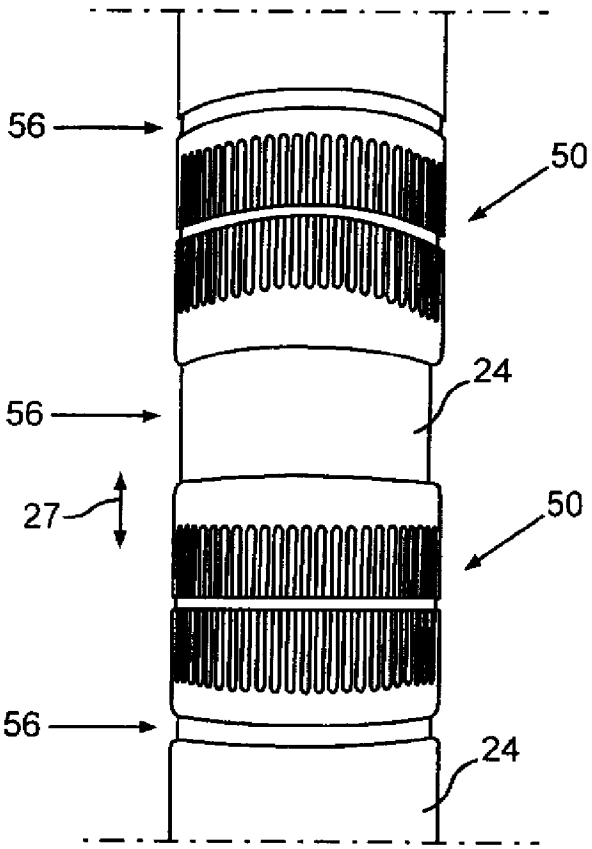
FIG. 11A a schematic plan view of another embodiment of a sleeve according to FIG. 7A, and FIG. 11B a detail of a schematic and enlarged plan view of the sleeve according to FIG. 11.
Figure 11A:
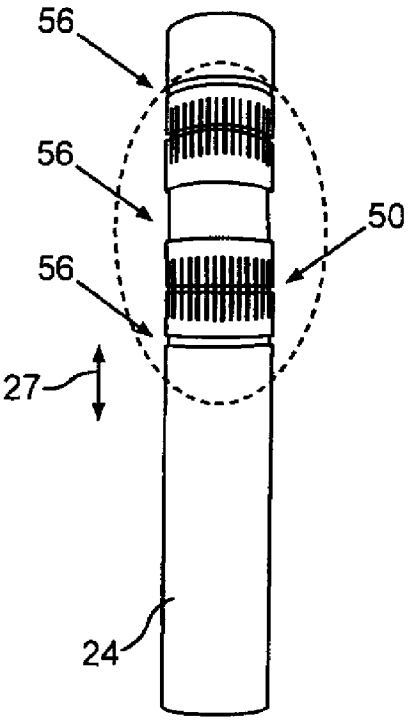

FIGS. 11A and 11B show another alternative embodiment of the sleeve 24 with the knurls 50. Notches 56 are formed in the axial direction of the sleeve 24 according to the direction of arrow 27 both between the knurls 50 and on the upper side and the lower side.

The invention claimed is:

1. A fuel feed device for attachment to a cylinder head of an internal combustion engine, comprising:

at least one fuel distribution element extending along a longitudinal direction, at least one connecting element extending in an axial direction transverse to the longitudinal direction and constructed to connect the at least one fuel distribution element to the cylinder head, and at least one reinforcing element, which is connected, on the one hand, to an outer surface of the at least one fuel distribution element and, on the other hand, to the at least one connecting element outside the at least one fuel distribution element, wherein the at least one reinforcing element comprises at least one through-opening configured for filling a receiving space disposed between the at least one reinforcing element and at least one of the at least one connecting element and fuel distribution element with a connecting means for materially connecting the at least one reinforcing element with at least one of the at least one connecting element and fuel distribution element.

2. The fuel feed device of claim 1, wherein the connecting means comprises a solder introduced into the receiving space.

3. The fuel feed device of claim 2, wherein the solder connects the at least one connecting element to the at least one fuel distribution element.

4. The fuel feed device of claim 1, wherein the at least one connecting element penetrates at least partially the at least one fuel distribution element.

5. The fuel feed device of claim 4, wherein the at least one connecting element penetrates a fuel distribution channel of the at least one fuel distribution element.

6. The fuel feed device of claim 1, wherein the at least one connecting element protrudes from the at least one fuel distribution element from both a top side and a bottom side of the at least one fuel distribution element in the axial direction of the at least one connecting element, and wherein the at least one reinforcing element is arranged on the top side of the at least one fuel distribution element and connected, on one hand, to an outer surface of the at least one fuel distribution element and, on the other hand, to the at least one connecting element outside the fuel distribution element, the fuel feed device further comprising at least one additional reinforcing element arranged on the bottom side of the at least one fuel distribution element and connected, on one hand, to the outer surface of the at least one fuel distribution element and, on the other hand, to the at least one connecting element outside the fuel distribution element.

* * * * *